US009670853B2

(12) United States Patent
Achiwa et al.

(10) Patent No.: US 9,670,853 B2
(45) Date of Patent: Jun. 6, 2017

(54) OUTBOARD MOTOR

(71) Applicant: SUZUKI MOTOR CORPORATION, Hamamatsu-Shi, Shizuoka (JP)

(72) Inventors: Tetsushi Achiwa, Hamamatsu (JP); Keisuke Daikoku, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 0 days.

(21) Appl. No.: 15/064,093

(22) Filed: Mar. 8, 2016

(65) Prior Publication Data

US 2016/0186677 A1 Jun. 30, 2016

Related U.S. Application Data

(63) Continuation of application No. PCT/JP2015/062952, filed on Apr. 30, 2015.

(30) Foreign Application Priority Data

May 30, 2014 (JP) ..... 2014-113058
May 30, 2014 (JP) ..... 2014-113061

(51) Int. Cl.
*B63B 35/73* (2006.01)
*F02B 61/04* (2006.01)
(Continued)

(52) U.S. Cl.
CPC ..... *F02D 41/003* (2013.01); *B63H 20/00* (2013.01); *B63H 20/32* (2013.01); *F02B 61/045* (2013.01);
(Continued)

(58) Field of Classification Search
CPC .... B63H 20/00; B63H 2020/00; B63H 20/32; F02B 61/045; F02D 41/003;
(Continued)

(56) References Cited

U.S. PATENT DOCUMENTS 5,829,402 A 11/1998 Takahashi et al.
6,044,817 A 4/2000 Hiraoka et al.
(Continued)

FOREIGN PATENT DOCUMENTS

JP H0988623 A 3/1997
JP H10220241 A 8/1998
(Continued)

*Primary Examiner* — Daniel V Venne
(74) *Attorney, Agent, or Firm* — Troutman Sanders LLP

(57) ABSTRACT

An outboard motor has a vertical-shaft vee engine unit provided with a crankshaft arranged approximately vertically and left and right cylinder units aligned to be open backward in a "V" shape as seen in a plan view. A surge tank and an air intake system unit provided with an intake pipe to connect the surge tank to intake ports of the left and right cylinder heads are arranged in a center of a width direction of a rear side of the engine unit. In addition, an electronic control unit is arranged in an approximate center of a height direction in the right side of the air intake system unit. Furthermore, a high-pressure fuel filter is arranged in an approximate center of a height direction in the left side of the air intake system unit. Moreover, a vapor separator embedded with a high-pressure fuel pump is arranged under the high-pressure fuel filter.

8 Claims, 11 Drawing Sheets

(51) Int. Cl.

| | |
|---|---|
| ***F02M 35/16*** | (2006.01) |
| ***F02D 41/00*** | (2006.01) |
| ***B63H 20/00*** | (2006.01) |
| ***F02M 37/20*** | (2006.01) |
| ***F02M 25/08*** | (2006.01) |
| ***F02M 35/10*** | (2006.01) |
| ***F02M 37/04*** | (2006.01) |
| ***F02M 37/22*** | (2006.01) |
| ***B63H 20/32*** | (2006.01) |
| *F02D 11/10* | (2006.01) |

(52) U.S. Cl.
CPC .... *F02M 25/0854* (2013.01); *F02M 25/0872* (2013.01); *F02M 35/10222* (2013.01); *F02M 35/16* (2013.01); *F02M 37/04* (2013.01); *F02M 37/20* (2013.01); *F02M 37/22* (2013.01); *F02D 2011/102* (2013.01); *F02D 2400/18* (2013.01); *F02D 2400/21* (2013.01)

(58) Field of Classification Search
CPC ..... F02D 2011/102; F02D 2400/18; F02D 2400/21; F02M 25/0854; F02M 25/0872; F02M 35/10222; F02M 37/04; F02M 37/22; F02M 35/16; F02M 37/20
USPC ..... 440/84, 88 R, 88 A, 88 F
See application file for complete search history.

(56) References Cited

U.S. PATENT DOCUMENTS

| | | | | |
|---|---|---|---|---|
| 8,544,440 | B2 * | 10/2013 | Hirose | F02B 31/04 123/184.61 |
| 2005/0229891 | A1 * | 10/2005 | Kokubo | F02M 35/10052 123/184.57 |
| 2007/0243778 | A1 | 10/2007 | Kamito et al. | |
| 2009/0215333 | A1 | 8/2009 | Ochiai | |
| 2010/0018498 | A1 | 1/2010 | Hirose | |
| 2013/0157532 | A1 | 6/2013 | Takano et al. | |
| 2013/0157533 | A1 | 6/2013 | Kato et al. | |
| 2013/0157534 | A1 | 6/2013 | Suzuki et al. | |

FOREIGN PATENT DOCUMENTS

| | | | |
|---|---|---|---|
| JP | 2005140045 | A | 6/2005 |
| JP | 2007283923 | A | 11/2007 |
| JP | 2009197744 | A | 9/2009 |
| JP | 2010031658 | A | 2/2010 |
| JP | 2013124592 | A | 6/2013 |
| JP | 2013124594 | A | 6/2013 |
| JP | 2013124595 | A | 6/2013 |

* cited by examiner

OUTBOARD MOTOR

CROSS-REFERENCE TO RELATED APPLICATIONS

This application is a continuation application of PCT International Application No. PCT/JP2015/062952, filed on Apr. 30, 2015 and designated the U.S., which claims the benefit of priority of the prior Japanese Patent Application Nos. 2014-113058, filed on May 30, 2014, and the prior Japanese Patent Application No. 2014-113061, filed on May 30, 2014, the entire contents of which are incorporated herein by reference.

TECHNICAL FIELD

The present invention relates to an outboard motor having a vertical-shaft vee internal combustion engine unit.

BACKGROUND ART

An outboard motor having an engine unit is provided with an electronic control unit for controlling the engine unit.

As one of such types of technologies, there is known an engine control unit (ECU) arranged on a front face of a cylinder block of an engine body.

Desirably, the electronic control unit is arranged around the engine unit, which is a control target, for efficient wiring.

Meanwhile, the engine unit of the outboard motor may be covered by an engine cover. When the electronic control unit is arranged around the engine unit, it is necessary to improve cooling efficiency of the electronic control unit.

In a ship, fuel stored in a fuel tank of a ship hull is pumped up to a subsidiary fuel tank, called a vapor separator, mounted in the outboard motor. The vapor separator stores the fuel supplied from the fuel tank and separates the vapor or air from the liquid fuel. The fuel stored in the vapor separator is pressurized by a high-pressure fuel pump, is supplied to an injector, and is then injected from an injector.

As one of such types of technologies, there is discussed in Patent Literature 2, a vertical-shaft vee engine unit having a vapor separator arranged in a lateral side of a crankcase and embedded with a secondary high-pressure pump. In addition, in Patent Literature 3, there is discussed a vertical-shaft vee engine unit having a vapor separator tank arranged close to a front end of a crankcase.

However, since heat is emitted to the surroundings from the crankcase and the like, the surroundings of the crankcase have a relatively high temperature. For this reason, if a vapor separator is arranged around the crankcase, the vapor separator is affected by the heat, and a temperature increases, so that a fuel vapor amount may increase unexpectedly.

Since the fuel stored in the vapor separator is pressurized by a high-pressure fuel pump and is supplied to the injector, it is necessary to arrange a fuel pipe capable of enduring a high pressure in the downstream side of the high-pressure fuel pump relatively to a fuel pipe in the upstream side. For example, as discussed in Patent Literature 1, if a vapor separator embedded with a secondary high-pressure pump is arranged in a lateral side of the crankcase, it is necessary to build a fuel pipe capable of enduring a high pressure to the injector arranged in the vicinity of the cylinder head. Therefore, the length of the high-pressure fuel pipe increases. Since the high-pressure fuel pipe is expensive more than the low-pressure fuel pipe, cost increases accordingly.

CITATION LIST

Patent Literature

Patent Literature 1: Japanese Laid-open Patent Publication No. 2009-197744

Patent Literature 2: Japanese Laid-open Patent Publication No. 2007-283923

Patent Literature 3: Japanese Laid-open Patent Publication No. 2013-124595

SUMMARY OF INVENTION

Technical Problem

In view of the aforementioned problems, it is therefore an object of the present invention to arrange components around a vertical-shaft vee engine unit without being affected by heat.

Solution to Problem

[1] According to an aspect of the present invention, there is provided an outboard motor having a vertical-shaft vee engine unit provided with a crankshaft arranged approximately vertically and left and right cylinder units aligned to be open backward in a "V" shape as seen in a plan view, the outboard motor including: a surge tank; an air intake system unit provided with an intake pipe to connect the surge tank to intake ports of the left and right cylinder units, the surge tank and the air intake system unit being arranged in a center of a width direction of a rear side of the vertical-shaft vee engine unit; and at least one of an electronic control unit as an electrical component or a vapor separator as a fuel supply system component arranged to adjoin a left or right side of the air intake system unit in a rear side of the vee engine unit.

[2] In the outboard motor according to [1], the electronic control unit may be arranged to adjoin any one of the left and right sides of the air intake system unit, and the vapor separator is arranged to adjoin the other side.

[3] In the outboard motor according to [1] or [2], the electronic control unit may have a flat casing and may be arranged to extend in front-rear and vertical directions of the outboard motor along a left or right side face of the air intake system unit.

[4] In the outboard motor according to [1] or [2], an electronically controlled throttle may be provided in an upper part of the air intake system unit, and the electronic control unit and the electronically controlled throttle may be connected to each other with a wiring harness.

[5] In the outboard motor according to [1] or [2], the fuel supply system component may further include all or a part of a high-pressure fuel pump, and a high-pressure fuel filter.

[6] In the outboard motor according to [5], the vapor separator may be embedded with the high-pressure fuel pump and may be arranged under an intake pipe of the lowermost cylinder of the air intake system unit.

[7] In the outboard motor according to [6], the vapor separator embedded with the high-pressure fuel pump may be arranged under the high-pressure fuel filter.

[8] In the outboard motor according to [2], a low-pressure fuel pump for supplying fuel to the vapor separator from a fuel tank may be arranged under the electronic control unit.

Advantageous Effects of Invention

According to the present invention, it is possible to arrange components around the vertical-shaft vee engine unit without being affected by heat. That is, since the electrical component is arranged in a lateral side of the air intake system unit, it is possible to obtain efficient wiring and improve cooling efficiency. In addition, since the fuel supply system component is arranged in a lateral side of the air intake system unit, it is possible to prevent the fuel supply system component from being affected by heat. When the fuel supply system component is the vapor separator, it is possible to shorten the high-pressure fuel pipe.

DESCRIPTION OF EMBODIMENTS

A description will now be made for embodiments of the present invention with reference to the accompanying drawings.

Figure 1:
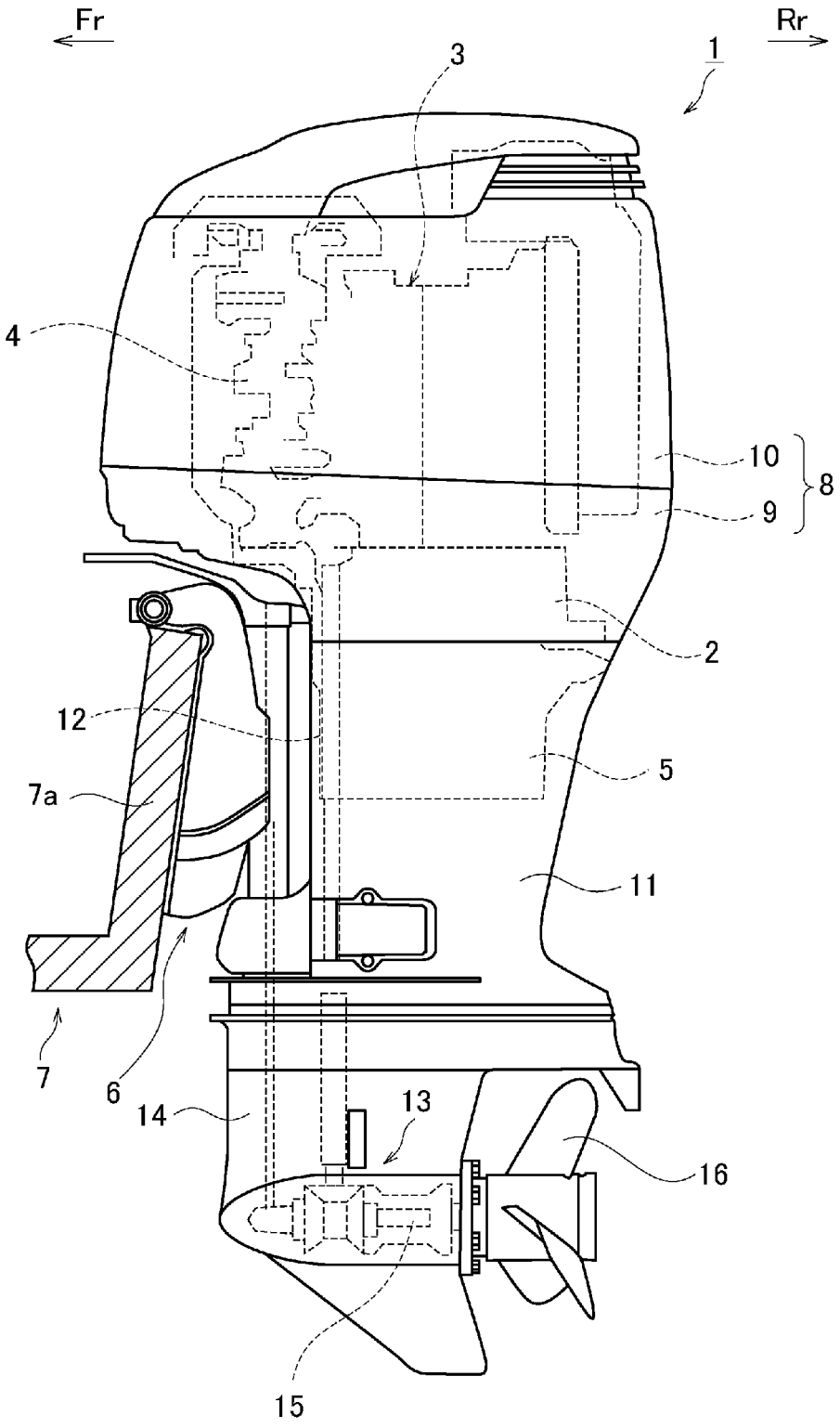
FIG. 1 is a left side view schematically illustrating an outboard motor.

Referring to FIG. 1, an outboard motor 1 has an engine holder 2 and an engine unit 3 mounted on the engine holder 2. A crankshaft 4 is approximately vertically arranged inside the engine unit 3, and left and right cylinder units are aligned to be open backward in a "V" shape as seen in a plan view. That is, the outboard motor 1 has a vertical-shaft water-cooled four-cycle six-cylinder vee (V6) engine unit with V-banks (refer to FIGS. 2A and 2B).

Under the engine holder 2, an oil pan 5 for storing lubricating oil is disposed. A bracket device 6 is installed in the outboard motor 1, so that the outboard motor 1 is mounted to a transom 7*a* of a ship 7 by using this bracket device 6. Herein, each direction is defined by indicating the ship 7 side as a front direction. In each drawing, "Fr" denotes a front direction, and "Rr" denotes a rear direction.

The surroundings of the engine unit 3, the engine holder 2, and the oil pan 5 are covered by an engine cover 8. The engine cover 8 includes a lower engine cover 9 that covers a lower half of the engine unit 3 from the lateral side and an upper engine cover 10 shrouded over the lower engine cover 9 to cover an upper half of the engine unit 3.

A drive shaft housing 11 is provided around and under the oil pan 5. A drive shaft 12 as an output shaft of the engine unit 3 is arranged approximately vertically inside the engine holder 2, the oil pan 5, and the drive shaft housing 11. A clutch mechanism 13 is arranged inside the gear casing 14 provided under the drive shaft housing 11. The drive shaft 12 extends downward inside the drive shaft housing 11 and is configured to drive a propeller 16 as a propulsion unit by using the clutch mechanism 13, the propeller shaft 15, and the like.

Figure 2A:
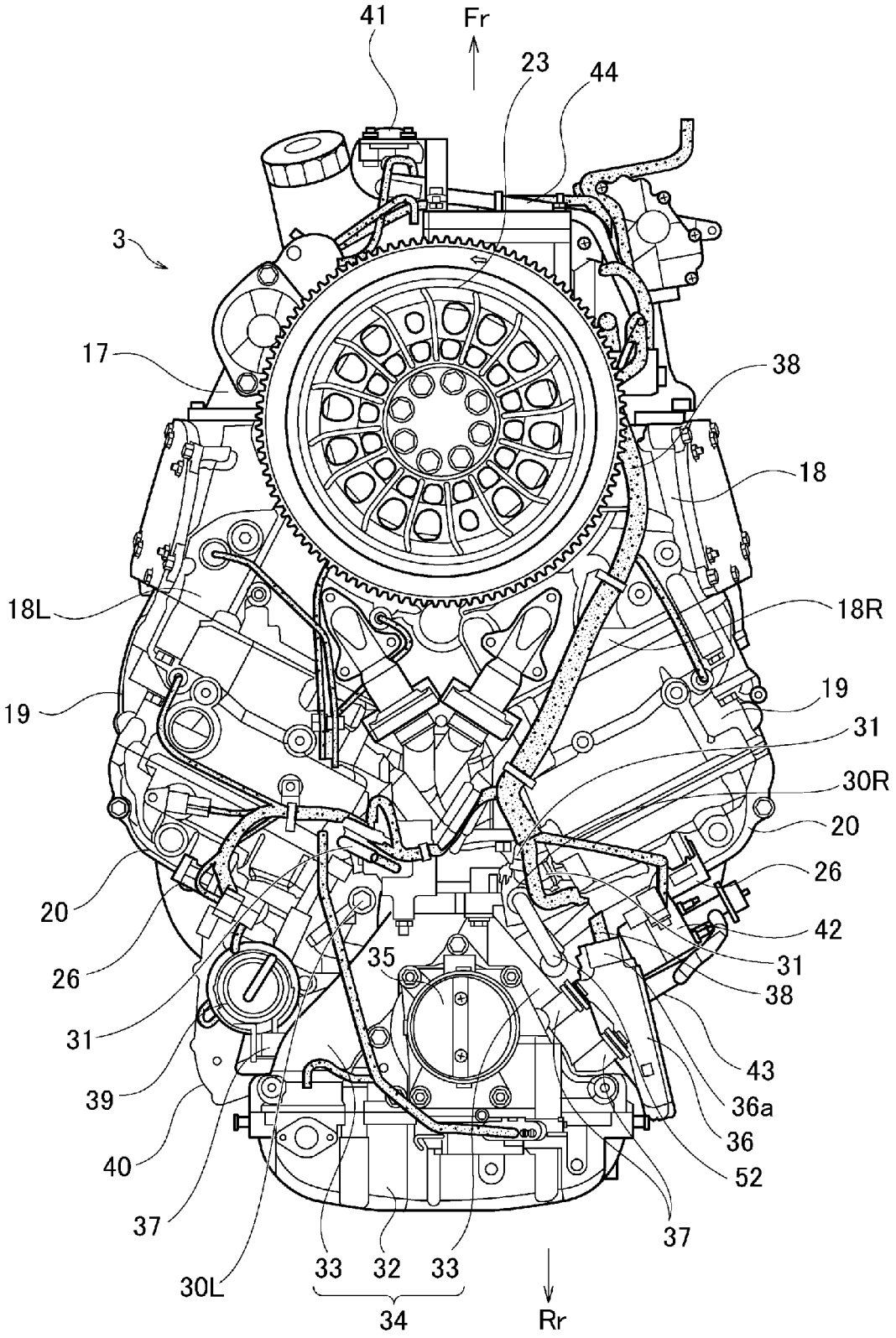
FIG. 2A is a top plan view illustrating the engine unit.
Figure 2B:
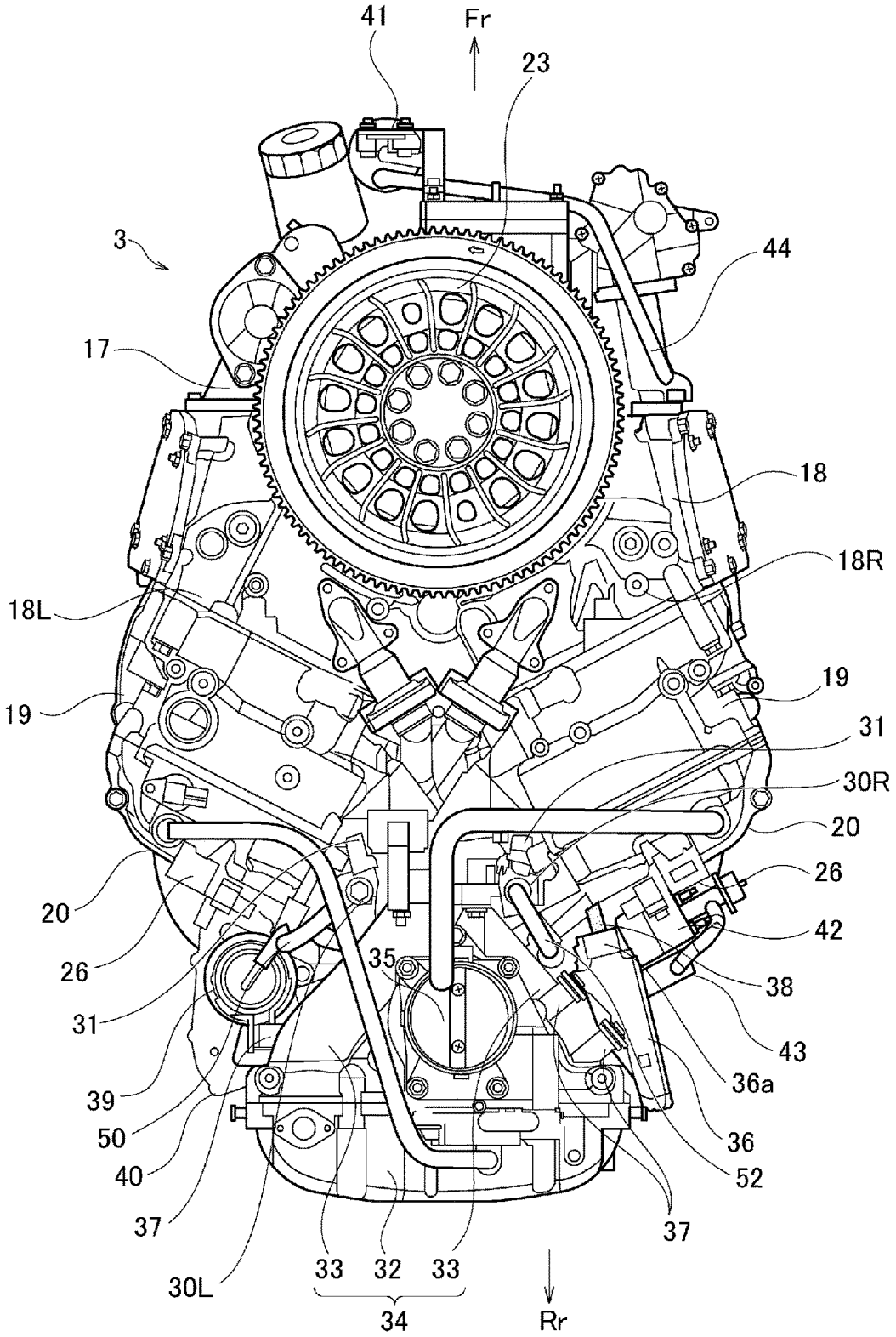
FIG. 2B is a top plan view illustrating the engine unit.

A description will now be made for a surrounding structure of the engine unit 3 with reference to FIGS. 2A to 7. It is noted that, although both FIGS. 2A and 2B are top plan views illustrating the engine unit 3, a part of components such as a wiring harness 38 illustrated in FIG. 2A are omitted from FIG. 2B, and a part of components such as a hose 50 illustrated in FIG. 2B are omitted from FIG. 2A for simplicity purposes. This relationship similarly applies between FIGS. 4A and 4B and between FIGS. 5A and 5B.

A crankcase 17 is disposed in a front part of the engine unit 3, and a cylinder block 18 is coupled to a rear part of the crankcase 17. The cylinder block 18 has left and right bank portions 18L and 18R aligned to be open backward in a "V" shape branching to the left and the right. A cylinder head 19 is provided for each of the left and right bank portions 18L and 18R, and a cylinder head cover 20 is covered in a rear part of each cylinder head 19. It is noted that the cylinder block 18, the cylinder head 19, and the cylinder head cover 20 will be referred to as a "cylinder unit."

Figure 3:
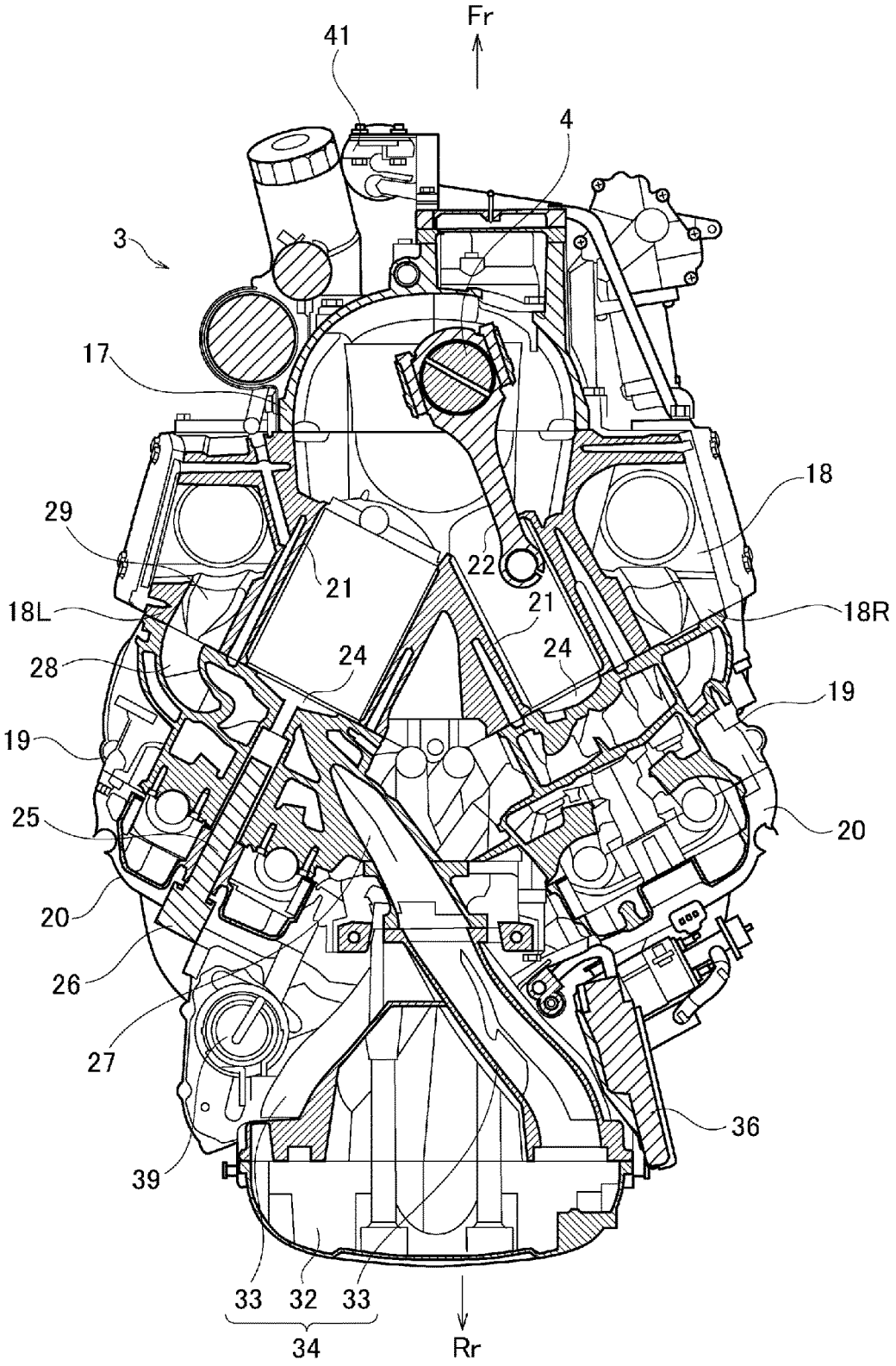
FIG. 3 is a cross-sectional top plan view illustrating the engine unit.

Referring to FIG. 3, three sleeves 21 (cylinders) having a cylindrical shape and extending vertically are provided in each of the left and right bank portions 18L and 18R side by side horizontally. A piston (not shown) is slidably inserted into each of the sleeves 21.

A crankshaft 4 is arranged vertically on a coupling surface between the crankcase 17 and the cylinder block 18, and the crankshaft 4 and the piston are connected to each other with a connecting rod 22, so that a piston reciprocation stroke is converted into a rotational motion of the crankshaft 4. A fly-wheel magneto unit 23 is connected to an upper end of the crankshaft 4.

Combustion chambers 24 matching the sleeves 21 are provided in the cylinder heads 19, and ignition plugs 25 are engaged from the outside. The ignition plug 25 is provided with an ignition coil 26 for an electrical discharge. In addition, an intake port 27 and an exhaust port 28 connected to the combustion chamber 24 are formed inside the cylinder head 19. The intake port 27 extends inward of the V-bank. The exhaust port 28 is connected to an exhaust passage 29 formed in the outside of the cylinder block 18. Although not shown in the drawings, intake and exhaust valves for opening or closing the ports 27 and 28, respectively, are arranged in the cylinder head 19.

Figure 8:
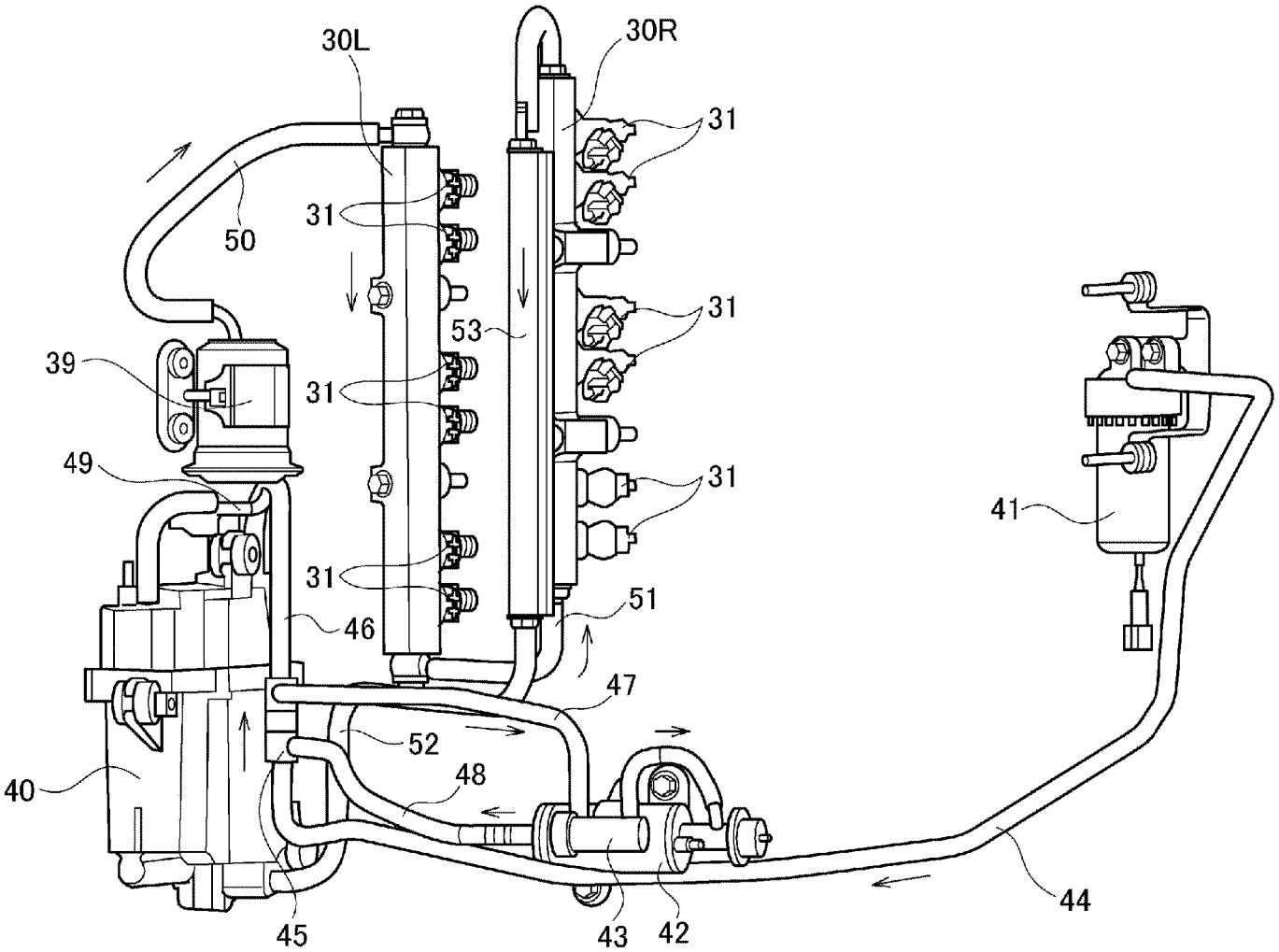
FIG. 8 is a diagram for describing a fuel supply system.

Left and right delivery pipes 30L and 30R are arranged inside the V-bank (refer to FIG. 8). Each of the delivery pipes 30L and 30R extends vertically, and two injectors 31 are provided in each cylinder. The injector 31 injects fuel to the air supplied to the intake port 27 to guide a mixture of the fuel and the air to the combustion chambers 24 of each cylinder.

An air intake system unit 34 is arranged in the center of the width direction of the rear side of the engine unit 3. The air intake system unit 34 has a surge tank 32 and an intake pipe 33 for connecting the surge tank 32 to the left and right intake ports 27 of the cylinder head 19.

The surge tank 32 is disposed in the rear side relatively to the cylinder unit and has a width matching the maximum opening width of the V-bank or larger and a height matching the height of the cylinder unit.

The intake pipes 33 are integrated as an intake manifold. Six intake pipes 33 are provided to match the number of cylinders. The intake pipes 33 are arranged to cross vertically and converge inward of the V-banks in an approximately V-shape.

In addition, an electronically controlled throttle 35 is installed in an upper part of the air intake system unit 34 to control the air flow rate introduced to the surge tank 32.

Figure 4A:
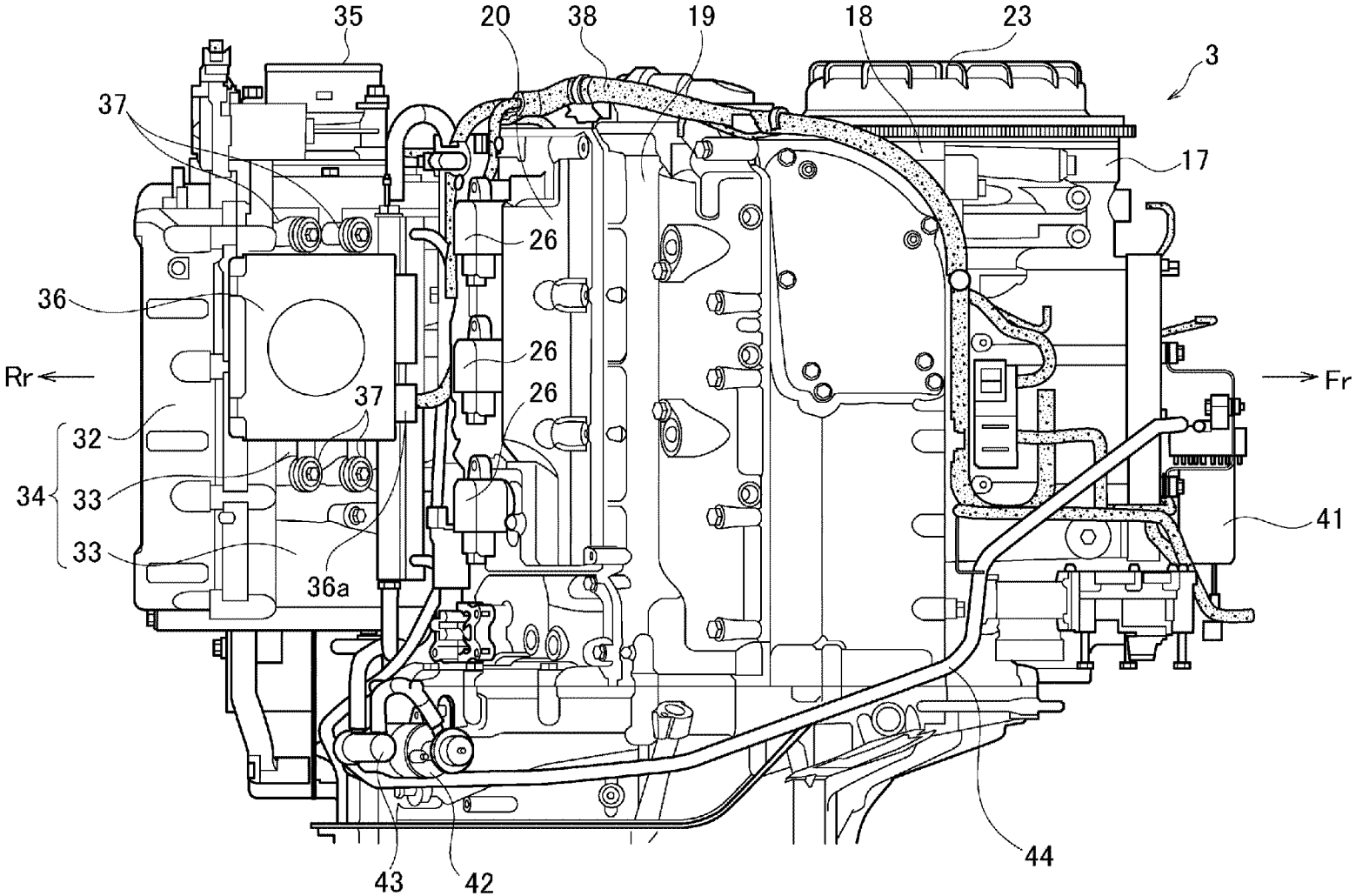
FIG. 4A is a right side view illustrating the engine unit.
Figure 4B:
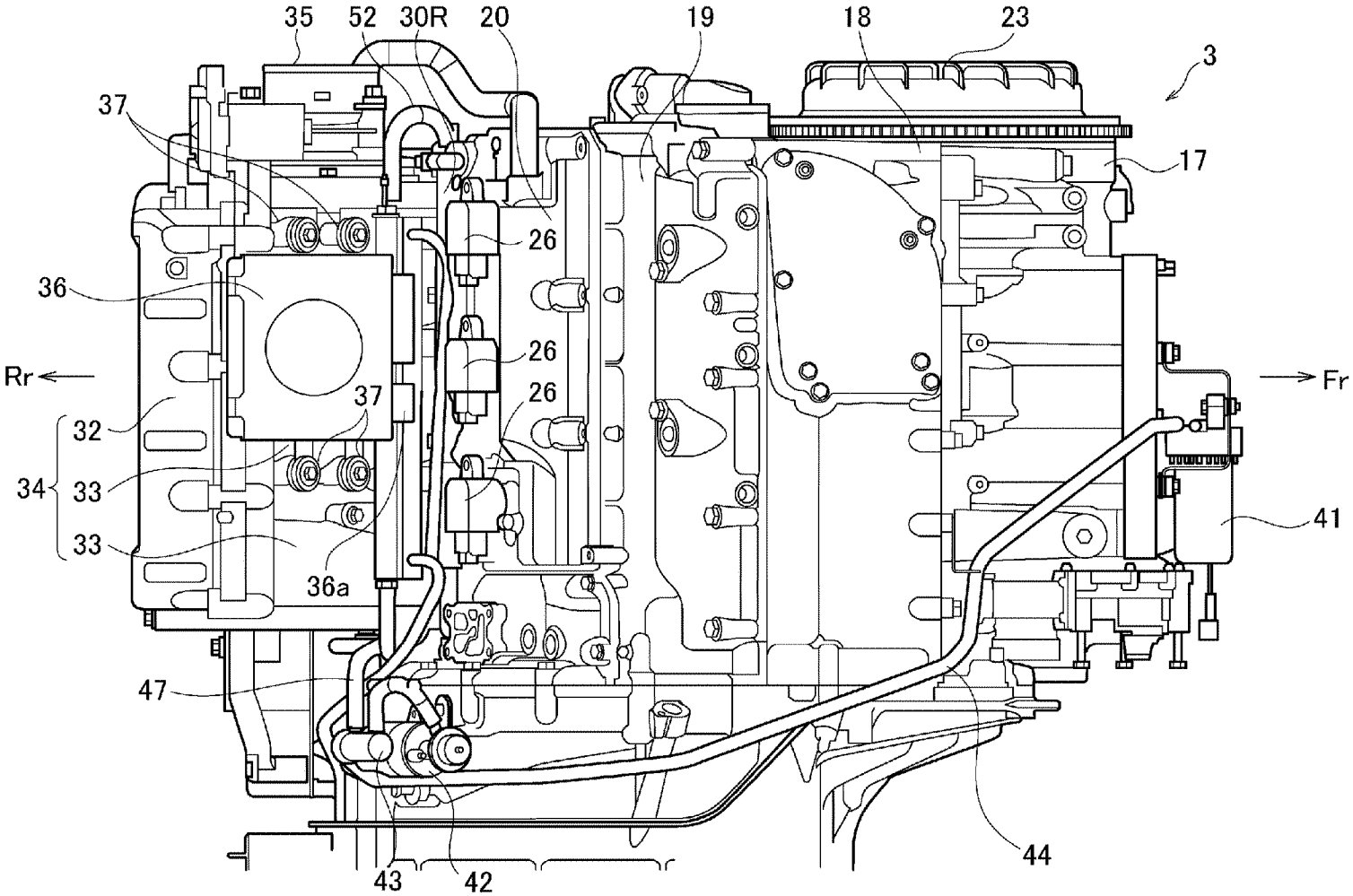
FIG. 4B is a right side view illustrating the engine unit.
Figure 6:
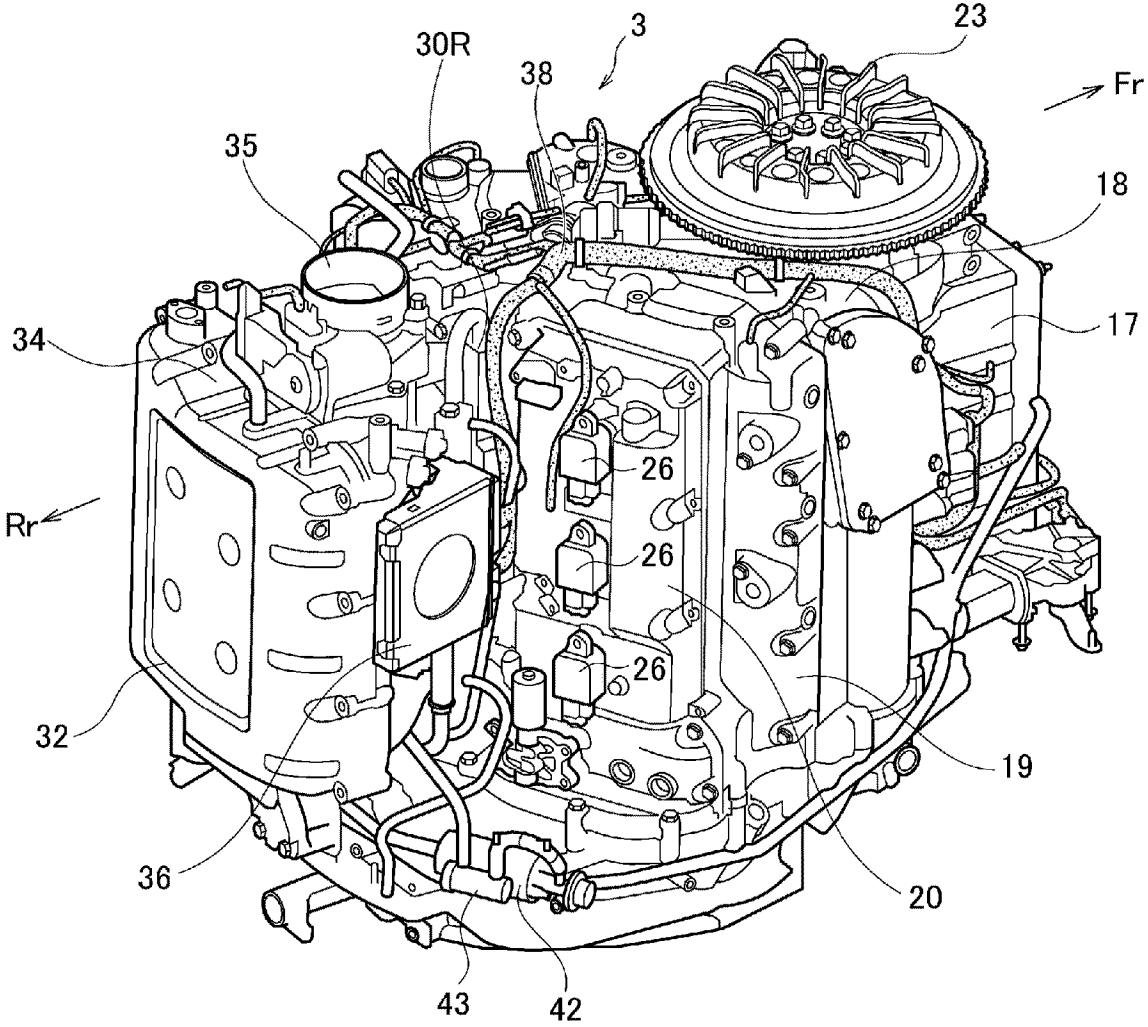
FIG. 6 is a perspective view illustrating the engine unit.

Here, as illustrated in FIGS. 4A, 4B, and 6, an electronic control unit 36 as an electrical component is arranged in an approximate center of the height direction in the right side of the air intake system unit 34. The electronic control unit 36 is housed in a casing and is arranged to face the air intake system unit 34, that is, to extend in front-rear and vertical directions. The casing of the electronic control unit 36 has a generally flat shape while its outside has a flat surface, and its inside is thickened to the front to match the intake pipe as illustrated in FIGS. 2A and 2B. The air intake system unit 34 is provided with boss portions 37 protruding to the lateral side. The boss portions 37 support the electronic control unit 36. When the electronic control unit 36 is supported by the boss portions 37, a vibration attenuating material is interposed preferably.

A connector portion 36*a* of the wiring harness 38 is provided in a front part of the electronic control unit 36. By extracting the wiring harness 38 from the front part of the electronic control unit 36, it is possible to allow the wiring harness 38 to extend upward in the lateral side of the engine unit 3 and creep along the upper surface of the engine unit 3 so that it can be connected to each component. It is noted that, in each drawing, the wiring harness 38 is shadowed for discrimination from other pipes.

Figure 5A:
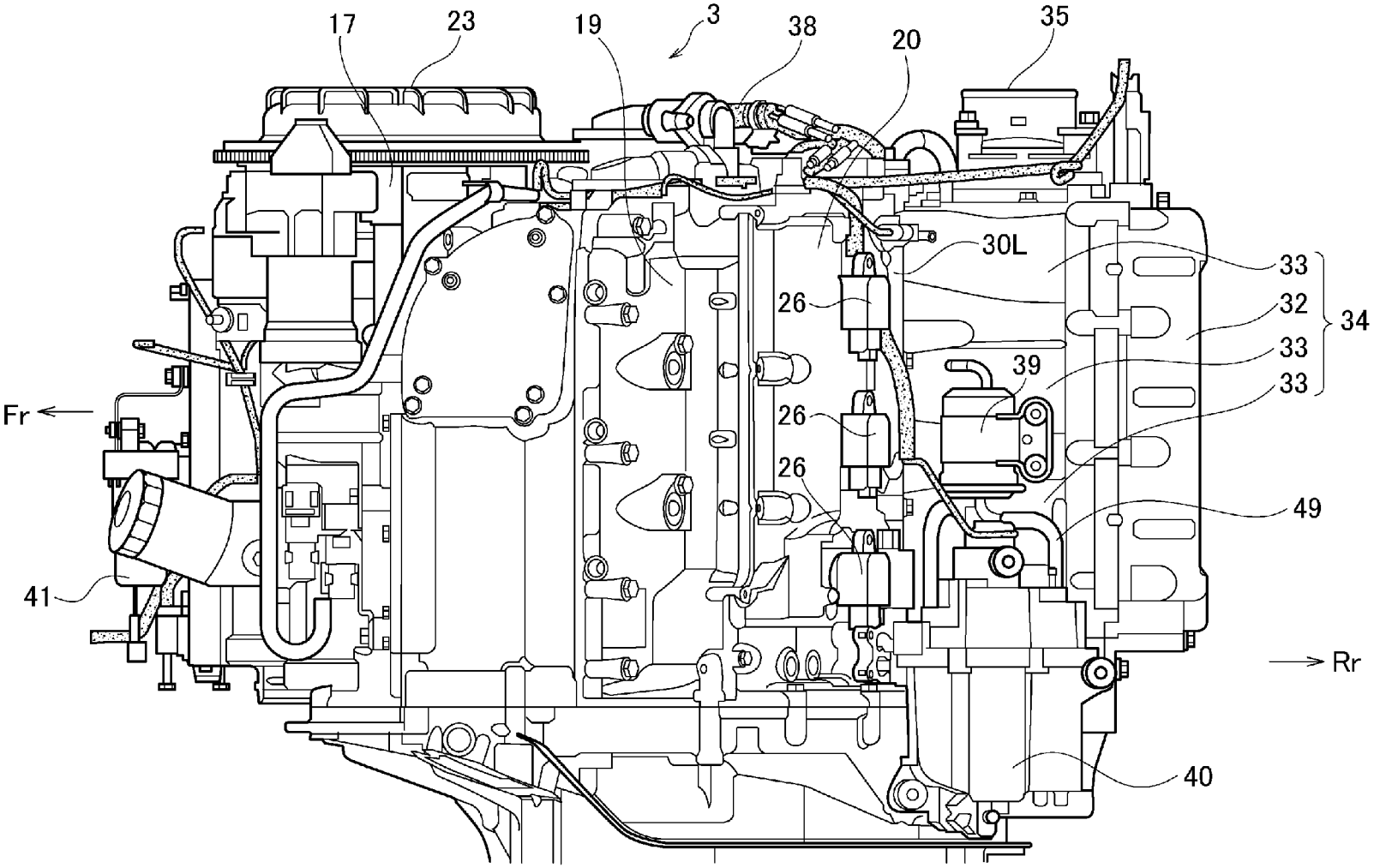
FIG. 5A is a left side view illustrating the engine unit.
Figure 5B:
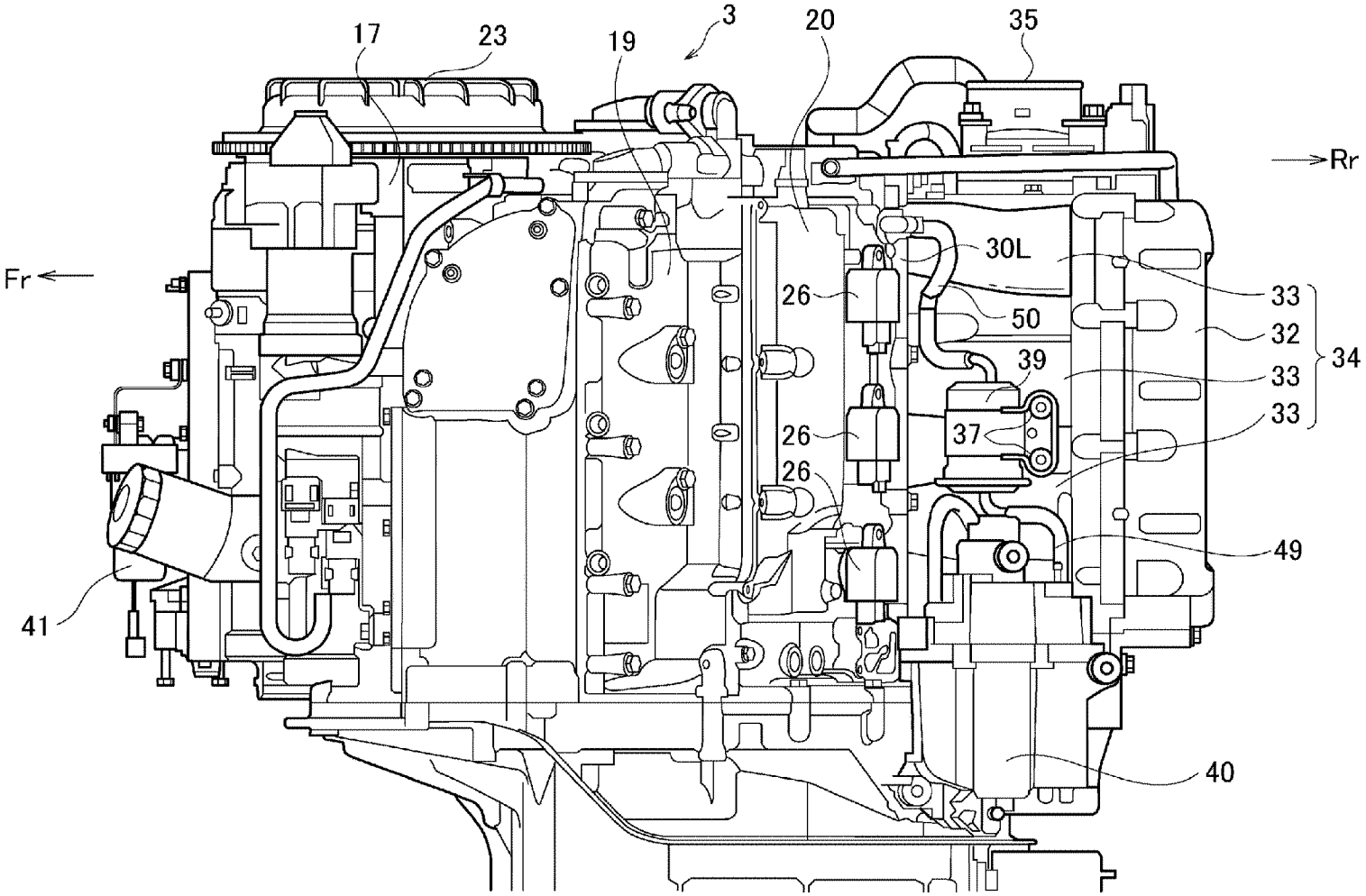
FIG. 5B is a left side view illustrating the engine unit.
Figure 7:
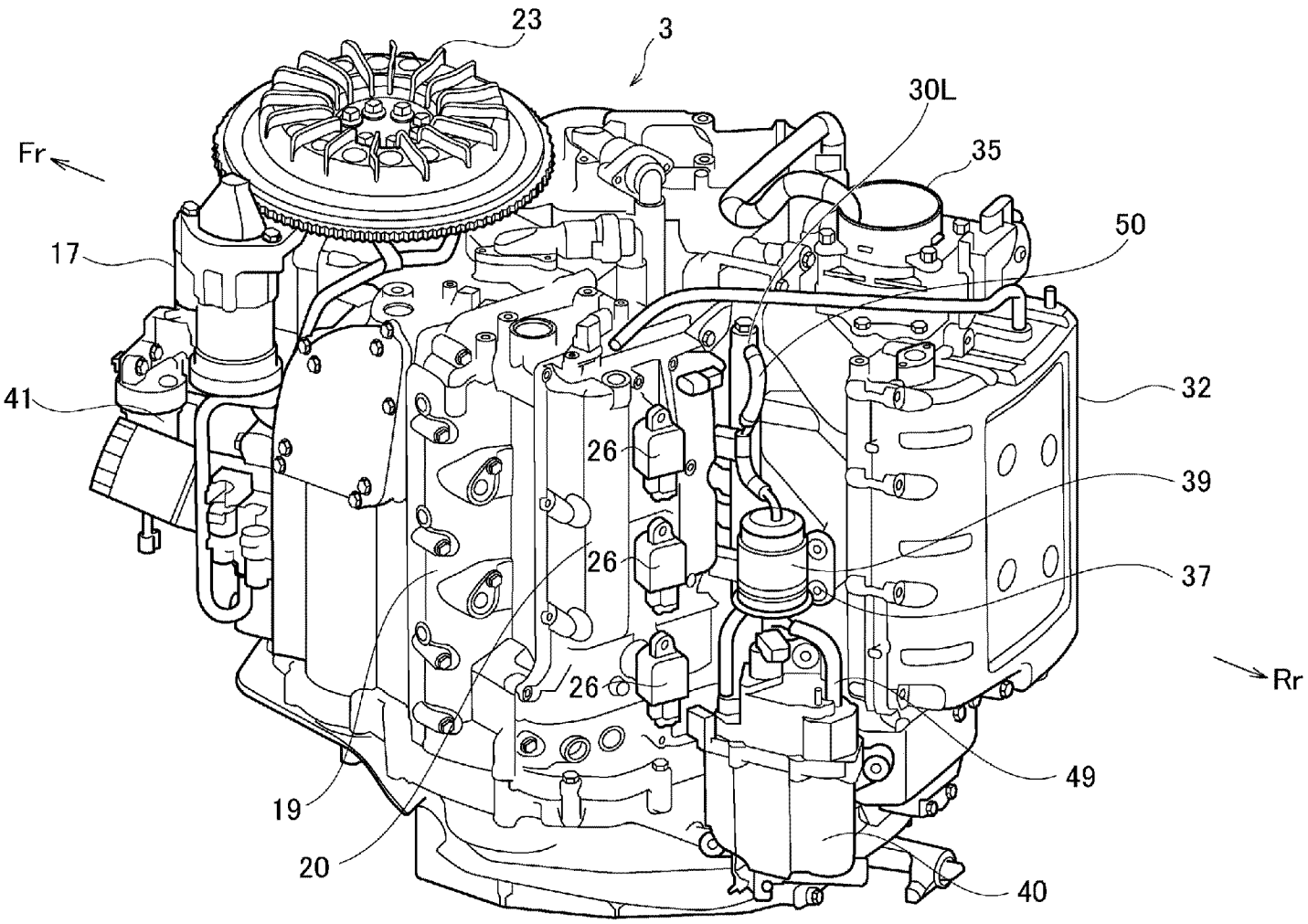
FIG. 7 is a perspective view illustrating the engine unit.

As illustrated in FIGS. 5A, 5B, and 7, a high-pressure fuel filter 39 as a fuel supply system component is arranged in an approximate center of the height direction in the left side of the air intake system unit 34. The air intake system unit 34 is provided with boss portions 37 protruding to the lateral side. The boss portions 37 support the high-pressure fuel filter 39.

A vapor separator 40 as a fuel supply system component is arranged under the high-pressure fuel filter 39, more specifically, under the intake pipe 33 of the lowermost cylinder of the air intake system unit 34. The vapor separator 40 is embedded with a high-pressure fuel pump. The high-pressure fuel pump embedded in the vapor separator 40 is a precision mechanical component and necessarily has an anti-vibration mechanism. If the engine unit 3 is cantilevered from the upside of the engine holder 2, an upper part of the engine unit 3 receives a more severe vibration. However, if the high-pressure fuel pump is arranged in a lower part of the engine unit 3 in this manner, it is possible to obtain a simple anti-vibration structure.

In addition, a first low-pressure fuel filter 41 is arranged in a front part of the engine unit 3. If the first low-pressure fuel filter 41 has a transparent casing, it is possible to visually recognize a property or state of the fuel (such as muddiness, sediments, degeneration, or deterioration). The first low-pressure fuel filter 41 is arranged in the front part of the engine unit 3 in order to facilitate a visual inspection or check and a filter exchange work.

A low-pressure fuel pump (pumping-up pump) 42 and a second low-pressure fuel filter 43 are arranged horizontally side by side under the electronic control unit 36, more specifically, under the intake pipe 33 of the lowermost cylinder of the air intake system unit 34 in the right side of the air intake system unit 34. Similar to the high-pressure fuel pump embedded in the vapor separator 40, the low-pressure fuel pump 42 is a precision mechanical component. By arranging the low-pressure fuel pump 42 in the lower part of the engine unit 3, it is possible to obtain a simple anti-vibration structure.

A description will now be made for a fuel supply system. Referring to FIG. 8, the fuel passing through the first low-pressure fuel filter 41 from the fuel tank of the ship hull side is guided to the vapor separator 40 via the hose 44, the one-way valve 45, and the hose 46. Here, a route including the hose 47, the second low-pressure fuel filter 43, the low-pressure fuel pump 42, and the hose 48 is connected to the one-way valve 45. When the engine starts (when the fuel is short in the vapor separator 40), the fuel is directly supplied to the vapor separator 40 from the fuel tank of the ship hull side by using a squeeze pump provided in the upstream of the first low-pressure fuel filter 41 without passing through the low-pressure fuel pump 42. As the fuel amount of the vapor separator 40 reaches its specified value, the fuel is supplied from the low-pressure fuel pump 42 automatically.

The fuel guided to the vapor separator 40 is guided to the high-pressure fuel filter 39 through the high-pressure hose 49 by the embedded high-pressure fuel pump. Then, the fuel is guided to the upper end of the delivery pipe 30L of the left bank through the high-pressure hose 50. The fuel passing through the delivery pipe 30L is injected from the injector 31, and the remaining fuel is guided from the lower end of the delivery pipe 30L to the lower end of the delivery pipe 30R of the right bank through the high-pressure hose 51. The fuel passing through the delivery pipe 30R is injected from the injector 31, and the remaining fuel is returned to the vapor separator 40 from the upper end of the delivery pipe 30R through the hose 52. In this case, the fuel is cooled by the fuel cooler 53.

As described above, triangular areas surrounded by the cylinder units and the engine cover 8 (not shown in the drawings except for FIG. 1) are provided in both sides of the air intake system unit 34. A relatively small-sized component such as the low-pressure fuel pump or the electronic control unit 36 is arranged in one of the triangular areas, and a relatively large-sized component such as the vapor separator 40 is arranged in the other triangular area. As a result, it is possible to achieve a balance between the left and the right and a compact structure.

In a vertical-shaft vee engine unit, heat is emitted from the crankcase 17 or the fly-wheel magneto unit 23. Meanwhile, heat is rarely emitted from a cylinder unit having a water jacket or the air intake system unit 34 where the air flows from the outside. That is, the rear part of the engine unit 3 tends to have a lower temperature in comparison with the front part.

By arranging the electronic control unit 36 in the lateral side of the air intake system unit 34 having a relatively lower temperature in this manner, it is possible to prevent degradation of integrity or performance of the electronic control unit 36. As a result, it is possible to eliminate necessity of heat insulation or heat dissipation measures and reduce cost. By arranging the electronic control unit 36 to face the air intake system unit 34 as described above, it is possible to more improve a cooling effect.

Similarly, by arranging the vapor separator 40 in the lateral side of the air intake system unit 34, as seen in a plan view, having a relatively lower temperature, it is possible to suppress the amount of the generated fuel vapor while the vapor separator 40 is not affected by the heat.

In the rear part of the engine unit 3, that is, in the cylinder unit side, control target members of the electronic control unit 36 include various components distributed in a wide area, such as the electronically controlled throttle 35, the ignition coil 26, injector 31, the high-pressure fuel pump (embedded with the vapor separator 40), the low-pressure fuel pump 42, and various sensors (not illustrated) such as a camshaft position sensor (CMP), an intake pressure sensor, an intake temperature sensor, a wall temperature sensor, an exhaust temperature sensor, a knocking sensor, and an oxygen sensor. Therefore, the number of the control target members of the electronic control unit 36 in the rear part of the engine unit 3 is larger than that in the front part of the engine unit 3. By arranging the electronic control unit 36 in the lateral side of the air intake system unit 34, it is possible to access the target members in the rear part of the engine unit 3 and effectively wire the wiring harness 38. By connecting the wiring harness 38 to the front part of the electronic control unit 36 as described above, it is possible to access the target members in the rear part of the engine unit 3 within a short distance and more reduce the length and weight of the wiring harness 38.

By arranging the vapor separator 40 (embedded with the high-pressure fuel pump) in the lateral side of the air intake system unit 34 as seen in a plan view, it is possible to access the delivery pipe 30L arranged in an inner side of the V-bank. As a result, it is possible to shorten the length of the high-pressure fuel pipe (high-pressure hoses 49 and 50) extending from the vapor separator 40 (embedded with the high-pressure fuel pump) to the delivery pipe 30 and reduce the cost. Furthermore, since the high-pressure fuel pipe (high-pressure hoses 49 and 50) passes through the lateral side of the air intake system unit 34 having a relatively lower temperature, it is possible to inject a proper amount of the fuel from the injector without overheating the fuel (if the fuel is overheated, vapor may be generated disadvantageously).

While the embodiments of the present invention have been described hereinbefore, it would be appreciated that they are not intended to limit the scope of the invention, and various changes or modifications can be possible within the scope of the present invention.

For example, the electronic control unit 36 may be arranged in the left side of the air intake system unit 34, and the high-pressure fuel filter 39 or the vapor separator 40 may be arranged in the right side.

INDUSTRIAL APPLICABILITY

The present invention can be applied to an outboard motor mounted to a vertical-shaft vee engine unit.

The invention claimed is:

1. An outboard motor having a vertical-shaft vee engine unit provided with a crankshaft arranged approximately vertically and left and right cylinder units arranged in a V shape, wherein the crankshaft is forward of the left and right cylinder units relative to a direction of thrust of the outboard motor, the outboard motor comprising:

an air intake system unit provided with a surge tank and an intake pipe to connect the surge tank to intake ports of the left and right cylinder units, the air intake system unit being arranged in a center of a left-right direction of a rear side of the vertical-shaft vee engine unit; and at least one of an electronic control unit as an electrical component or a vapor separator as a fuel supply system component arranged to adjoin a left or right side of the air intake system unit in a rear side of the vertical-shaft vee engine unit.

2. The outboard motor according to claim 1, wherein the electronic control unit is arranged to adjoin any one of the left and right sides of the air intake system unit, and the vapor separator is arranged to adjoin one of the left and right sides of the air intake system unit which the electronic control unit does not adjoin.

3. The outboard motor according to claim 1, wherein the electronic control unit has a flat casing and is arranged to extend in front-rear and vertical directions of the outboard motor along a left or right side face of the air intake system unit.

4. The outboard motor according to claim 1, wherein an electronically controlled throttle is provided in an upper part of the air intake system unit, and the electronic control unit and the electronically controlled throttle are connected to each other with a wiring harness.

5. The outboard motor according to claim 1, wherein the fuel supply system component further includes all or a part of a high-pressure injection fuel pump supplying fuel from the vapor separator to the cylinders and a high-pressure fuel filter.

6. The outboard motor according to claim 5, wherein the vapor separator includes all or part of the high-pressure injection fuel pump and is arranged under an intake pipe of the lowermost cylinder of the air intake system unit.

7. The outboard motor according to claim 6, wherein the vapor separator including all or part of the high-pressure injection fuel pump is arranged under the high-pressure fuel filter.

8. The outboard motor according to claim 2, wherein a low-pressure fuel supply pump for supplying fuel to the vapor separator from a fuel tank is arranged under the electronic control unit.

* * * * *